US009153864B2

(12) United States Patent
Iwata et al.

(10) Patent No.: US 9,153,864 B2
(45) Date of Patent: Oct. 6, 2015

(54) VEHICLE POLE ANTENNA

(75) Inventors: Toshihiro Iwata, Tokyo (JP); Yuya Fukasawa, Tokyo (JP); Toshiro Yokoyama, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 190 days.

(21) Appl. No.: 13/397,521

(22) Filed: Feb. 15, 2012

(65) Prior Publication Data

US 2012/0206315 A1 Aug. 16, 2012

(30) Foreign Application Priority Data

Feb. 15, 2011 (JP) ..... 2011-029508

(51) Int. Cl.

| | |
|---|---|
| ***H01Q 1/32*** | (2006.01) |
| ***H01Q 1/36*** | (2006.01) |
| ***H01Q 1/50*** | (2006.01) |
| ***H01Q 1/42*** | (2006.01) |
| ***H01Q 1/08*** | (2006.01) |

(52) U.S. Cl.
CPC ..... *H01Q 1/42* (2013.01); *H01Q 1/085* (2013.01); *H01Q 1/3275* (2013.01); *H01Q 1/362* (2013.01)

(58) Field of Classification Search
CPC ..... H01Q 1/40; H01Q 11/86; H01Q 11/08
USPC ..... 343/715, 872
See application file for complete search history.

(56) References Cited

U.S. PATENT DOCUMENTS

| | | | |
|---|---|---|---|
| 3,659,678 | A | 5/1972 | Hall, Jr. |
| 4,019,203 | A | 4/1977 | Yamanashi et al. |
| 4,490,003 | A | 12/1984 | Robinson |
| 4,563,659 | A | 1/1986 | Sakamoto |
| 4,781,623 | A | 11/1988 | Philippson et al. |
| 4,866,407 | A | 9/1989 | Ikeda |
| 5,195,014 | A | 3/1993 | Krantz, Jr. et al. |
| 5,198,958 | A | 3/1993 | Krantz, Jr. et al. |
| 5,363,114 | A | 11/1994 | Shoemaker |
| 5,525,071 | A | 6/1996 | Obara et al. |
| 5,565,877 | A | 10/1996 | Du et al. |
| 5,668,559 | A | 9/1997 | Baro |

(Continued)

FOREIGN PATENT DOCUMENTS

| | | | | |
|---|---|---|---|---|
| CN | 201041825 | * | 3/2008 | |
| CN | 101479878 | | 7/2009 | |
| DE | 60105892 | | 10/2005 | |
| EP | 01143557 | * | 10/2001 | ..... 343/872 |

(Continued)

OTHER PUBLICATIONS

U.S. Appl. No. 12/769,488, filed Apr. 28, 2010, Richard Breden.

*Primary Examiner* — Dameon E Levi
*Assistant Examiner* — Ricardo Magallanes
(74) *Attorney, Agent, or Firm* — Wells St. John P.S.

(57) ABSTRACT

A vehicle pole antenna fixed to an antenna support base includes: a rod 10, a helical antenna element 20, a joint 30, and a mast cover 40. The rod 10 has flexibility and insulation property and has a concave portion 11 at its base end surface. The helical antenna element 20 has a coated wire wound around the rod 10. A winding density of the helical antenna element 10 adjacent to a bending start point of the rod is lower than that at the other portions. The joint 30 has a convex portion 31 to be fitted to the concave portion 11 formed at the base end surface of the rod 10. The joint 30 is electrically connected with the helical antenna element 20 and connected to the antenna support base.

17 Claims, 2 Drawing Sheets

(56) References Cited

U.S. PATENT DOCUMENTS

| | | | | |
|---|---|---|---|---|
| 5,732,440 | A | 3/1998 | Wright | |
| 5,757,327 | A | 5/1998 | Yajima et al. | |
| 5,797,771 | A | 8/1998 | Garside | |
| 5,995,064 | A | 11/1999 | Yanagisawa et al. | |
| 6,062,897 | A * | 5/2000 | McCarthy | 439/427 |
| 6,175,080 | B1 | 1/2001 | Nightingale | |
| 6,177,911 | B1 | 1/2001 | Yuda et al. | |
| 6,259,411 | B1 * | 7/2001 | Yanagisawa et al. | 343/713 |
| 6,310,586 | B1 | 10/2001 | Takahashi et al. | |
| 6,373,448 | B1 * | 4/2002 | Chun | 343/895 |
| 6,486,842 | B2 | 11/2002 | Wang | |
| 6,501,427 | B1 | 12/2002 | Lilly et al. | |
| 6,747,603 | B1 | 6/2004 | Tornatta et al. | |
| 6,879,301 | B2 | 4/2005 | Kozlovski | |
| 6,940,366 | B2 | 9/2005 | Komiya | |
| 7,019,701 | B2 | 3/2006 | Ohno et al. | |
| 7,037,144 | B2 | 5/2006 | Wang et al. | |
| 7,148,850 | B2 | 12/2006 | Puente Baliarda et al. | |
| 7,156,678 | B2 | 1/2007 | Feldman et al. | |
| 7,164,386 | B2 | 1/2007 | Baliarda et al. | |
| 7,170,459 | B1 | 1/2007 | McKim | |
| 7,202,822 | B2 | 4/2007 | Baliarda et al. | |
| 7,210,965 | B1 | 5/2007 | Zhong et al. | |
| 7,271,773 | B2 | 9/2007 | Gorai et al. | |
| 7,312,761 | B2 | 12/2007 | Gorai et al. | |
| 7,394,438 | B2 | 7/2008 | Forster et al. | |
| 7,414,588 | B2 | 8/2008 | Tateno | |
| 7,420,517 | B2 | 9/2008 | Oshima et al. | |
| 1,274,615 | A1 | 11/2008 | Wang | |
| 1,280,946 | A1 | 12/2008 | Lino | |
| 1,249,511 | A1 | 6/2009 | Kobayashi | |
| 7,554,490 | B2 | 6/2009 | Baliarda et al. | |
| 7,579,998 | B1 | 8/2009 | Fang et al. | |
| 7,598,913 | B2 | 10/2009 | Rao et al. | |
| 7,671,504 | B2 | 3/2010 | Rohrer et al. | |
| 1,289,802 | A1 | 10/2010 | Sato | |
| 7,845,983 | B2 | 12/2010 | Kawada et al. | |
| 1,252,484 | A1 | 1/2011 | Wang | |
| 7,868,834 | B2 | 1/2011 | Ortigosa et al. | |
| 7,928,913 | B2 | 4/2011 | Kaneda et al. | |
| 7,952,533 | B2 | 5/2011 | Hur et al. | |
| 7,961,065 | B2 | 6/2011 | Kobayashi et al. | |
| 8,207,893 | B2 | 6/2012 | Baliarda et al. | |
| 8,212,726 | B2 | 7/2012 | Baliarda et al. | |
| 8,471,772 | B2 | 6/2013 | Baliarda et al. | |
| 8,497,807 | B2 | 7/2013 | Wakui et al. | |
| 8,502,742 | B2 | 8/2013 | Wakui et al. | |
| 8,605,002 | B2 | 12/2013 | Nishi et al. | |
| 2001/0022716 | A1 | 9/2001 | Glaser et al. | |
| 2001/0050649 | A1 | 12/2001 | Wang | |
| 2002/0021254 | A1 * | 2/2002 | Wang et al. | 343/715 |
| 2002/0050873 | A1 | 5/2002 | Tsunoda et al. | |
| 2002/0080088 | A1 | 6/2002 | Boyle | |
| 2003/0058186 | A1 * | 3/2003 | Saito et al. | 343/895 |
| 2003/0112191 | A1 | 6/2003 | Maeda et al. | |
| 2003/0228806 | A1 | 12/2003 | Wang et al. | |
| 2004/0090366 | A1 | 5/2004 | Wong et al. | |
| 2004/0119644 | A1 | 6/2004 | Puente-Baliarda et al. | |
| 2004/0233108 | A1 | 11/2004 | Bordi | |
| 2005/0195112 | A1 | 9/2005 | Baliarda et al. | |
| 2005/0200530 | A1 | 9/2005 | Aikawa et al. | |
| 2005/0231427 | A1 | 10/2005 | Baliarda et al. | |
| 2005/0264453 | A1 | 12/2005 | Baliarda et al. | |
| 2006/0040562 | A1 | 2/2006 | Funatsu | |
| 2006/0097937 | A1 | 5/2006 | Gorai et al. | |
| 2006/0187131 | A1 | 8/2006 | Oshima | |
| 2006/0232488 | A1 | 10/2006 | Wang et al. | |
| 2006/0274472 | A1 | 12/2006 | Saito et al. | |
| 2006/0290587 | A1 | 12/2006 | Forster et al. | |
| 2007/0152886 | A1 | 7/2007 | Baliarda et al. | |
| 2007/0279302 | A1 | 12/2007 | Byrne et al. | |
| 2008/0117111 | A1 | 5/2008 | Ikeda et al. | |
| 2008/0198082 | A1 | 8/2008 | Soler Castany et al. | |
| 2009/0109101 | A1 | 4/2009 | Baliarda et al. | |
| 2009/0115551 | A1 | 5/2009 | Kobayashi et al. | |
| 2009/0140927 | A1 | 6/2009 | Maeda et al. | |
| 2009/0153404 | A1 | 6/2009 | Ryou et al. | |
| 2009/0156059 | A1 | 6/2009 | Zhu et al. | |
| 2009/0207084 | A1 | 8/2009 | Ikeda et al. | |
| 2009/0237313 | A1 | 9/2009 | Martinez Ortigosa | |
| 2009/0267847 | A1 * | 10/2009 | Sato et al. | 343/713 |
| 2009/0280688 | A1 | 11/2009 | Kawada et al. | |
| 2009/0284441 | A1 * | 11/2009 | Wakui | 343/895 |
| 2009/0295645 | A1 | 12/2009 | Campero et al. | |
| 2009/0303134 | A1 | 12/2009 | Baliarda et al. | |
| 2010/0007566 | A1 | 1/2010 | Kobayashi et al. | |
| 2010/0009565 | A1 | 1/2010 | Wang | |
| 2010/0245189 | A1 | 9/2010 | Wang | |
| 2010/0265145 | A1 | 10/2010 | Chung | |
| 2010/0265147 | A1 | 10/2010 | Wakui et al. | |
| 2010/0277380 | A1 | 11/2010 | Breden | |
| 2011/0074524 | A1 | 3/2011 | Nishioka | |
| 2011/0102269 | A1 | 5/2011 | Sato et al. | |
| 2011/0177839 | A1 | 7/2011 | Baliarda et al. | |
| 2011/0181478 | A1 | 7/2011 | Baliarda et al. | |
| 2011/0181481 | A1 | 7/2011 | Baliarda et al. | |
| 2011/0260934 | A1 | 10/2011 | Ilno et al. | |
| 2012/0326934 | A1 | 12/2012 | Wakui et al. | |
| 2013/0176180 | A1 | 7/2013 | Wakui et al. | |

FOREIGN PATENT DOCUMENTS

| | | | |
|---|---|---|---|
| EP | 1162685 | | 12/2001 |
| JO | 11-040920 | | 2/1999 |
| JP | 55-138913 | | 10/1980 |
| JP | 59-078711 | | 5/1984 |
| JP | 60-128963 | | 6/1985 |
| JP | 2-32223 | | 2/1990 |
| JP | 04-257111 | | 9/1992 |
| JP | 05-058223 | | 3/1993 |
| JP | U1993 039009 | | 5/1993 |
| JP | 05-191124 | | 7/1993 |
| JP | 06-203897 | | 7/1994 |
| JP | 7-36381 | | 4/1995 |
| JP | 7272942 | | 10/1995 |
| JP | 9213528 | | 8/1997 |
| JP | 09-232851 | | 9/1997 |
| JP | 10-056315 | | 2/1998 |
| JP | 2000-353573 | | 12/2000 |
| JP | 2001-127522 | A * | 5/2001 |
| JP | WO01/31736 | * | 5/2001 |
| JP | 2001-291540 | | 10/2001 |
| JP | 2001-345613 | | 12/2001 |
| JP | 2003-521146 | | 7/2003 |
| JP | 2003-264043 | | 9/2003 |
| JP | 2004-031068 | | 1/2004 |
| JP | 2004-082749 | | 3/2004 |
| JP | 2004-153502 | | 5/2004 |
| JP | 2004-159153 | | 6/2004 |
| JP | 2005-102031 | | 4/2005 |
| JP | 2005-110200 | | 4/2005 |
| JP | 2006-033172 | | 2/2006 |
| JP | 2008/035479 | | 2/2006 |
| JP | 2006-108848 | | 4/2006 |
| JP | 2006-121369 | | 5/2006 |
| JP | 2006-166041 | | 6/2006 |
| JP | 2006-178647 | | 6/2006 |
| JP | 2006-186881 | | 7/2006 |
| JP | 2007-036354 | | 2/2007 |
| JP | 2007-072952 | | 3/2007 |
| JP | 2007-124892 | | 5/2007 |
| JP | 2006-059646 | | 3/2008 |
| JP | 2008-523671 | | 7/2008 |
| JP | 2009-290377 | | 12/2009 |
| JP | 2010-021856 | | 1/2010 |
| JP | 2011-035519 | | 2/2011 |
| WO | 2008/062746 | | 5/2006 |
| WO | WO 2007/020902 | | 2/2007 |
| WO | PCT/JP2007/000505 | | 5/2007 |
| WO | WO 2008/001482 | | 1/2008 |
| WO | PCT/JP2010/058364 | | 5/2010 |
| WO | PCT/JP2012/050527 | | 9/2012 |

* cited by examiner

VEHICLE POLE ANTENNA

CROSS REFERENCE TO RELATED APPLICATION

This U.S. patent relates to and claims priority to corresponding Japanese Patent Application Serial No. 2011-029508, which was filed on Feb. 15, 2011, and the entire disclosure is incorporated herein by reference.

BACKGROUND OF THE INVENTION

1. Field of the Invention

The present invention relates to a vehicle pole antenna, and more particularly to a vehicle pole antenna having a helical antenna element.

2. Description of the Related Art

A vehicle pole antenna is limited in terms of physical length, so that a helical antenna element capable of reducing an antenna's physical length as compared to an antenna effective length is generally used for the vehicle pole antenna. Further, the vehicle pole antenna is generally designed to have flexibility in consideration of a possibility that the antenna itself collides with an object. However, if the vehicle pole antenna having the helical antenna element bends due to collision, a winding pitch of the helical antenna element may be shifted to change the antenna effective length thereof, which may result in a change of electrical characteristics.

To solve the above problem, Patent Document 1 discloses a helical antenna in which a coated wire obtained by coating a core wire with an insulating coating material is helically and closely wound and in which a winding pitch thereof is determined by the thickness of the coating material. With this configuration, the winding pitch can be kept constant even when the antenna bends.

Patent Document 2 discloses a vehicle pole antenna including an antenna element which has a helical antenna element constructed by inserting a helical coil with elasticity into a helical groove of a rod and in which a coil spring is provided between the rod and a base side element metal fitting. With this configuration, the antenna element can bend at the coil spring part to prevent the winding pitch thereof from being changed to reduce a change of electrical characteristics and to remove bending tendency.

CITATION LIST

Patent Document

Patent Document 1: Japanese Patent Application Kokai Publication No. 2001-127522

Patent Document 2: Japanese Patent Application Kokai Publication No. 2005-260432

The pole antenna of the above Patent Document 1 has a configuration in which the coated wire is closely wound and the winding pitch is determined by the thickness of the coating material, as described above. However, when the pole antenna bends, the helical antenna element is deformed and compressed to overlap adjacent coated wires with each other, with the result that the winding pitch is changed or that the bending tendency remains. Thus, a change in the electrical characteristics could not have been prevented.

In the case of the pole antenna of the above Patent Document 2, the coil spring is provided between the rod and the base side element metal fitting and thus the number of parts is increased not only to lead to an increase of cost but also to create a limit to a reduction in the antenna length. Further, in this approach, the helical groove needs to be formed, complicating the antenna structure.

In recent years, a reduction in the physical length of the vehicle pole antenna has been demanded for appearance reasons or in terms of a relationship with a rear hatch of a hatch back car. However, in the case of a complicated structure like the pole antenna of the above Patent Document 2, such a demand could not be made. Further, the following problem can be found even in the case of the structure like the pole antenna of the above Patent Document 1. That is, assume that a material with higher flexibility is adopted as the rod so as not to allow the bending tendency to remain. In this case, when the physical length of the vehicle pole antenna is made shorter, the bending degree is increased to increase a possibility of an occurrence of the change in the winding pitch.

SUMMARY OF THE INVENTION

The present invention has been made in view of the above situation, and an object thereof is to provide a vehicle pole antenna capable of reducing a change of the electrical characteristics caused due to the bending and capable of reducing the physical length of the antenna.

To attain the above object of the present invention, there is provided a vehicle pole antenna comprising: a rod with flexibility and insulation property, the rod having a concave portion at its base end surface; a helical antenna element which includes a coated wire wound around the rod and a winding density of which around a bending start point of the rod is lower than that at the other portions; a conductive joint having a convex portion to be fitted to the concave portion formed at the base end surface of the rod, the conductive joint being electrically connected with the helical antenna element and connected to the antenna support base; and a mast cover with flexibility and insulation property covering at least the helical antenna element.

The bending start point of the rod may be a portion adjacent to the leading end of the convex portion of the joint.

The helical antenna element may have a hook portion at a leading end thereof to be hooked onto a leading end surface of the rod.

The joint may have a fastened portion and an annular fastening portion between which the helical antenna element is held and fastened.

The fastened portion and/or the annular fastening portion may have a breaking portion for breaking up a coating material of the coated wire of the helical antenna element so as to allow the helical antenna element to be electrically connected to the joint.

The convex portion of the joint may be protruded more than the annular fastening portion in a direction toward an antenna leading end.

The mast cover may have, between itself and a leading end portion of the helical antenna element, a space into which the helical antenna element escapes.

The vehicle pole antenna of the present invention has an advantage that it can reduce a change of electrical characteristics caused due to bending and reduce the physical length of the antenna.

PREFERRED EMBODIMENTS OF THE INVENTION

Figure 1:
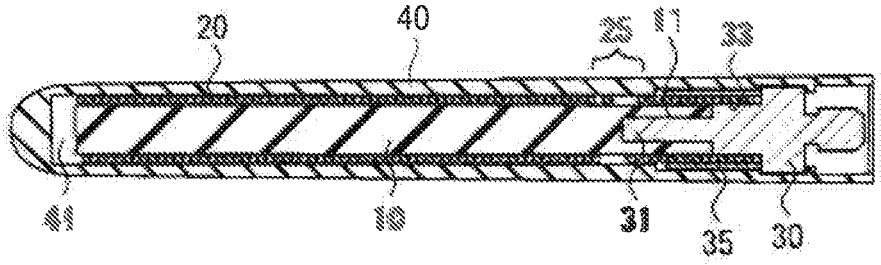
FIG. 1 is a schematic longitudinal cross-sectional view for explaining a vehicle pole antenna according to the present invention.

Preferred embodiments of the present invention will be described below with reference to the accompanying drawings. FIG. 1 is a schematic longitudinal cross-sectional view for explaining a vehicle pole antenna according to the present invention. As illustrated, a vehicle pole antenna of the present invention mainly includes a rod 10, a helical antenna element 20, a joint 30, and a mast cover 40. Such a vehicle pole antenna is fixed to an antenna support base (not illustrated) mounted on, e.g., a roof of a vehicle. Through the antenna support base, the vehicle pole antenna is electrically connected to an amplifier or a receiver provided inside the vehicle.

The rod 10 has flexibility and insulation property. Specifically, the rod 10 is preferably made of, e.g., an urethane based material. Particularly, in the case where length of the pole antenna is made physically short, if the rod is poorly returned from a deformation, there is a possibility that the rod cannot be returned to its original shape after bending, so that elastomer made of a polyacetal material or a polypropylene material having high flexibility is preferably used to form the rod 10. A concave portion 11 is formed in an end surface of a base of the rod 10, i.e., the end surface of the pole antenna on the side near the vehicle. The diameter of the rod 10 is, for example, ϕ5.5 mm.

The helical antenna element 20 includes a coated wire wound around the rod 10. Specifically, a copper wire coated with, e.g., a polyurethane resin or a polyester resin is preferably used as the helical antenna element 20. The diameter of the coated wire of the helical antenna element 20 is, for example, ϕ0.8 mm. The helical antenna element 20 is basically closely wound, that is, wound in such a manner that there is no gap between adjacent coated wires. Thus, a winding pitch of the helical antenna element 20 is determined by the thickness of a coating material of the coated wire. In the helical antenna element 20 of the vehicle pole antenna according to the present invention, the winding density adjacent to a starting point from which the rod 10 bends is lower than the winding density at the other portions. The gap in this coarsely wound portion 25 is, for example, about 5 mm. This gap may appropriately be adjusted according to the flexibility of the rod 10.

When the rod 10 bends, the bending portion is a portion nearer to the base portion than to the leading end portion of the pole antenna. Specifically, a portion adjacent to the leading end of the joint 30 to be described later receives the greatest force, at which the rod 10 starts bending. In the present invention, the winding density adjacent to the bending start point is made coarse so as to allow the coarsely wound portion 25 to absorb a change of the helical antenna element 20 when the rod 10 bends. Thus, even when the rod 10 bends, the winding pitch at a closely wound portion of the helical antenna element 20 is less subject to change, thereby reducing a change of electrical characteristics due to the bending.

The joint 30 has conductivity and is connected to the antenna support base (not illustrated). The antenna support base is fixed to, e.g., a roof of the vehicle so as to support the vehicle pole antenna. Through the antenna support base, the helical antenna element 20 is electrically connected to an amplifier or a receiver provided inside the vehicle. The joint 30 is electrically connected with the helical antenna element 20. Further, the joint 30 has a convex portion 31 to be fitted to the concave portion 11 of the end surface of the base of the rod 10. The bending start point of the rod 10 is located adjacent to the leading end of the convex portion 31. Thus, the coarsely wound portion 25 of the helical antenna element 20 is preferably disposed adjacent to the convex portion 31 of the joint 30. Arbitrarily changing the length of the convex portion 31 allows the position of the bending start point of the rod 10 to be changed arbitrarily.

Figure 2:
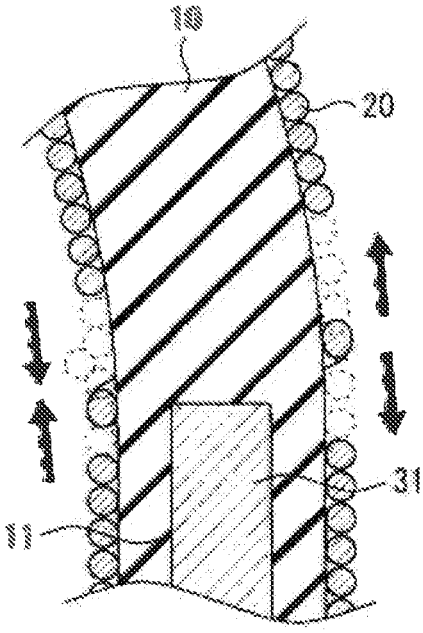
FIG. 2 is a partly enlarged schematic view illustrating a part at which a rod of the vehicle pole antenna according to the present invention bends.

FIG. 2 is a partly enlarged schematic view illustrating a part at which a rod of the vehicle pole antenna according to the present invention bends. In FIG. 2, the same reference numerals as those in FIG. 1 denote the same parts as those in FIG. 1. As illustrated, the rod 10 bands most prominently adjacent to the leading end of the convex portion 31 of the joint 30. Adjacent coated wires of the helical antenna element 20 are compressed to each other at the inner side of the bending portion of the rod 10, while separated from each other at the outer side thereof. At this time, as represented by broken circles, in the case where the helical antenna element at the bending start point is not coarsely wound but closely wound, the adjacent coated wires of the helical antenna element on the compressed side may overlap each other to cause one of the adjacent coated wires to be protruded outside from the surface of the rod 10, that is, plastic deformation can happen. However, the helical antenna element 20 of the vehicle pole antenna according to the present invention at the bending start point is coarsely wound as represented by solid circles, so that even when the rod 10 bends, deformation of the helical antenna element 20 can be escaped to the coarsely wound portion. Therefore, a change in the antenna effective length of the helical antenna element 20 can be reduced, thereby allowing a reduction in the change of the electrical characteristics. Particularly, in the case where the physical length of the vehicle pole antenna is shortened, the flexibility is increased to allow the rod 10 to significantly bend. In this case, however, since the helical antenna element 20 positioned at the bending start point is coarsely wound, the adjacent coated wires of the helical antenna element 20 are prevented from being plastically deformed.

As described above, in the vehicle pole antenna according to the present invention, the helical antenna element 20 is not fixed relative to the rod 10, but configured to be freely moved to some extent in the longitudinal direction thereof. Further, the helical antenna element 20 is coarsely wound around the bending start point of the rod 10 at which it bends most prominently, so that even when the helical antenna element 20 is compressed, there is a space into which the helical antenna element 20 can escape. This can minimize the deformation such as the protrusion of the coated wire. Therefore, the helical antenna element 20 is configured to be moved freely to some extent in the longitudinal direction thereof with the winding pitch of the closely wound portion not changed so much. Even though the helical antenna element 20 is not fixed to the rod 10, it is preferably wound around the rod 10 with a certain degree of strength so as to prevent hitting sound between the rod 10 and the helical antenna element 20 from being generated due to vibration.

A fastened portion 33 may be formed in the joint 30. Referring again to FIG. 1, the fastened portion 33 is formed in a middle stage of the joint 30. More specifically, the fastened portion 33 is formed on the surface of a part of the joint 30 that has the same diameter as that of the rod 10. An annular fastening portion 35 for holding and fastening the helical antenna element 20 with the fastened portion 33 is formed so as to surround the joint 30. With this configuration, the helical antenna element 20 is held and fastened between the fastened portion 33 and the annular fastening portion 35 to fix the helical antenna element 20 to the joint 30. Further, the fitting portion between the concave portion 11 and the convex portion 31 is fastened to achieve fixation of the rod 10 to the joint 30.

The following describes an electrical connection between the helical antenna element 20 and the joint 30. As a matter of course, soldering or the like may be used to electrically connect the helical antenna element 20 to the joint 30. However, adopting the following structure allows omission of the soldering process and provides a much more simple assembly. That is, a breaking portion threaded in, e.g., a helical fashion is formed in the fastened portion 33. When the annular fastening portion 35 is fastened, the coating material of the coated wire of the helical antenna element 20 is broken up by the breaking portion formed in the fastened portion 33, causing the breaking portion to be brought into contact with (bite into) a conductor wire under the coating material. As a result, the joint 30 and the helical antenna element 20 are electrically connected to each other. Although the breaking portion is formed in the fastened portion 33 of the joint 30 in the above example, the present invention is not limited to this, but the breaking portion may be formed on the inner surface of the annular fastening portion 35. Further alternatively, the breaking portion may be formed both in the fastened portion 33 and the annular fastening portion 35. In the case where the breaking portion is formed on the inner surface of the annular fastening portion 35, the annular fastening portion 35 is made to be electrically connected to the joint 30, thereby allowing the helical antenna element 20 to be electrically connected to the joint 30 through the annular fastening portion 35. Further, although the threaded breaking portion has been taken as an example, the breaking portion may be formed into a needle-like or flange-like structure as long as it can penetrate the coating material to electrically contact the coated wire. Further alternatively, the breaking portion may be formed so as to run in a direction opposite to the winding direction of the helical antenna element 20. This increases a contact area between the breaking portion and the coated wire, thereby ensuring more reliable electrical conduction.

The annular fastening portion 35 is preferably formed so as not to extend beyond the convex portion 31 of the joint 30 in the direction toward the pole antenna leading end and so as not to surround the coarsely wound portion 25 of the helical antenna element 20. That is, the convex portion 31 of the joint 30 is preferably protruded more than the annular fastening portion 35 in the direction toward the antenna leading end. In the case where the convex portion 31 of the joint 30 is so short that it is completely surrounded by the annular fastening portion 35, the bending start point of the rod 10 is located adjacent to the leading end side of the annular fastening portion 35. At this time, when the coarsely wound portion 25 of the helical antenna element 20 is centered around the leading end of the annular fastening portion 35, a part of the coarsely wound portion 25 is surrounded by the annular fastening portion 35 with the result that the coarsely wound portion 25 may be reduced in area due to the fastening force of the annular fastening portion 35. When the convex portion 31 of the joint 30 is protruded relative to the annular fastening portion 35, the bending start point of the rod 10 is located adjacent to the leading end of the convex portion 31. Thus, when the coarsely wound portion 25 is centered around this portion, the coarsely wound portion 25 is not surrounded by the annular fastening portion 35.

The mast cover 40 is provided so as to cover the helical antenna element 20 having the above configuration. The mast cover 40 has flexibility and insulation property. Specifically, like the rod 10, the mast cover 40 may be urethane-based elastomer. Between the helical antenna element 20 and a leading end portion, to provide a space 41 is preferable into which the helical antenna element 20 escapes when the helical antenna element 20 is extended in the longitudinal direction. More specifically, the space 41 is preferably provided between the inner surface of the leading end portion of the mast cover 40 and the leading end surface of the helical antenna element 20. When the rod 10 bends, tension force is applied to the helical antenna element 20 allowing the helical antenna element 20 to extend in the longitudinal direction of the pole antenna temporarily. At this time, if the space between the mast cover 40 and the leading end portion of the helical antenna element 20 is not provided, the adjacent coated wires of the helical antenna element 20 may overlap each other to be plastically deformed. Thus, by providing the space into which the helical antenna element escapes as illustrated in FIG. 1, the plastic deformation can be prevented. The mast cover 40 is configured to allow the helical antenna element 20 to be moved freely to some extent in the longitudinal direction of the pole antenna and configured to contact the helical antenna element 20 with a certain pressure so as to prevent hitting sound between the helical antenna element 20 and the mast cover 40 from being generated. Alternatively, a configuration may be adopted in which only a portion around the coarsely wound portion of the helical antenna element 20 at which the deformation may occur most significantly is configured to be movable freely to some extent, while the closely wound portion is formed integrally with the rod 10 or the mast cover 40 by insert molding.

Figure 3:
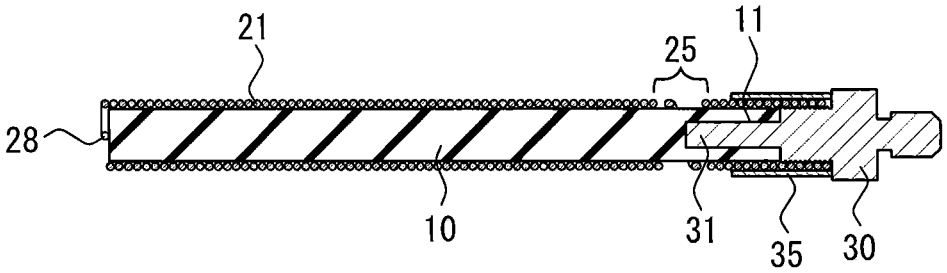
FIG. 3 is a schematic longitudinal cross-sectional view for explaining another example of the vehicle pole antenna according to the present invention.
Figure 4:
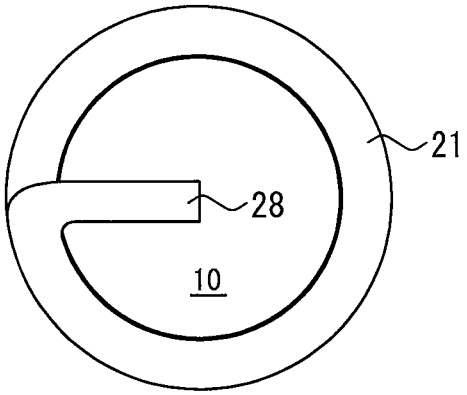
FIG. 4 is a schematic view illustrating a leading end surface of the vehicle pole antenna of FIG. 3.

The following describes another example of the vehicle pole antenna according to the present invention with reference to FIG. 3. FIG. 3 is a schematic longitudinal cross-sectional view for explaining another example of the vehicle pole antenna according to the present invention. FIG. 4 is a schematic view illustrating a leading end surface of the vehicle pole antenna of FIG. 3. In FIGS. 3 and 4, the same reference numerals as those in FIG. 1 denote the same parts as those in FIG. 1, so that the detailed descriptions thereof will be omitted. The mast cover 40 have the same configuration as that of FIG. 1, so that the illustration thereof is omitted in FIGS. 3 and 4. In the illustrated example, the helical antenna element 21 has, at its leading end, a hook portion 28 to be hooked onto the leading end surface of the rod 10. This point differs from the vehicle pole antenna of FIG. 1.

Forming the hook portion 28 can prevent the helical antenna element 21 from being reduced in length as compared to the rod 10. That is, though the coarsely wound portion 25 is provided to the helical antenna element 21 of the vehicle pole antenna of the present invention, in the absence of the hook portion 28, the helical antenna element 21 may have the potential to be moved to the base side of the pole antenna by its own weight to crush the coarsely wound portion 25. The crush of the coarsely wound portion 25 may cause a change of the electrical characteristics. However, in the instance illustrated in FIGS. 3 and 4, the hook portion 28 is hooked onto the leading end surface of the rod 10 to thereby prevent the helical antenna element 21 from being reduced in length as compared to the rod 10, in other words, prevent the helical antenna element 21 from dropping along the outer surface of the rod 10.

The hook portion 28 is not completely fixed to the rod 10 so as not to prevent the helical antenna element 21 from being temporarily extended in the longitudinal direction of the pole antenna when the rod 10 bends. This can prevent an occurrence of the plastic deformation of the helical antenna element due to the bending of the pole antenna.

The vehicle pole antenna of the present invention is not limited to the above illustrated examples, but may be variously modified within the scope of the present invention.

What is claimed is:

1. A vehicle pole antenna fixed to an antenna support base, comprising:

a rod with flexibility and insulation property, the rod having a concave portion at its base end surface;

a helical antenna element having a coated wire wound around the rod;

a joint with conductivity having a convex portion fitted to the concave portion formed at the base end surface of the rod, the joint being electrically connected with the helical antenna element and connected to the antenna support base;

a mast cover with flexibility and insulation property covering at least the helical antenna element;

wherein a winding density of the helical antenna element adjacent to a leading end of the convex portion of the joint comprises a lower density than winding densities at other segments of the helical antenna element, the lower winding density is configured to provide a space into which the helical antenna element can escape when the rod bends; and wherein the joint has a fastened portion and an annular fastening portion between which the helical antenna element is held and fastened.

2. The vehicle pole antenna according to claim 1, wherein the helical antenna element has a hook portion at a leading end thereof to be hooked over a leading end surface of the rod.

3. The vehicle pole antenna according to claim 1, wherein the fastened portion and/or the annular fastening portion has a breaking portion for breaking up a coating material of the coated wire of the helical antenna element so as to allow the helical antenna element to be electrically connected to the joint.

4. The vehicle pole antenna according to claim 1, wherein the convex portion of the joint is protruded more than the annular fastening portion in a direction toward an antenna leading end.

5. The vehicle pole antenna according to claim 1, wherein the mast cover has, between itself and a leading end portion of the helical antenna element, a space into which the helical antenna element escapes.

6. The vehicle pole antenna according to claim 1, wherein the coated wire of the helical antenna element is wound around a receiving section of the joint, the receiving section of the joint comprising a diameter substantially equal to a diameter of the rod.

7. The vehicle pole antenna according to claim 1, wherein the joint comprises a breaking portion configured to penetrate the coating of the coating wire, the breaking portion comprising a helical structure.

8. A vehicle pole antenna comprising:

a flexible rod;

a helical antenna element supported upon the flexible rod and comprising a first winding density and a second winding density different from the first winding density, the helical antenna element comprising only one second winding density, the helical antenna element comprising only two different winding densities;

a conductive joint secured to one end of the flexible rod and configured to be secured to a vehicle, the joint being electrically connected with the helical antenna element; and wherein the conductive joint has a fastened portion and an annular fastening portion between which the helical antenna element is held and fastened.

9. The vehicle pole antenna according to claim 8, wherein the helical antenna element comprises only two first winding densities.

10. The vehicle pole antenna according to claim 8, wherein the conductive joint comprises a terminal end in the flexible rod.

11. The vehicle pole antenna according to claim 10, wherein the second winding density is adjacent the terminal end of the conductive joint.

12. The vehicle pole antenna according to claim 8, wherein the conductive joint comprises a terminal end in the flexible rod, a segment of the flexible rod adjacent the terminal end configured to provide a first flex point of the flexible rod most proximate the conductive joint.

13. The vehicle pole antenna according to claim 12, wherein the second winding density is located at the first flex point of the flexible rod.

14. The vehicle pole antenna according to claim 8, wherein the different winding densities allow the helical antenna element to move freely in a longitudinal direction of the flexible rod so as to allow the helical antenna element to absorb a change of the helical antenna element when the flexible rod bends.

15. A vehicle pole antenna fixed to an antenna support base, comprising:

a rod with flexibility and insulation property, the rod having a concave portion at its base end surface;

a helical antenna element having a coated wire wound around the rod;

a joint with conductivity having a convex portion fitted to the concave portion formed at the base end surface of the rod, the joint being electrically connected with the helical antenna element and connected to the antenna support base;

a mast cover with flexibility and insulation property covering at least the helical antenna element;

wherein a winding density of the helical antenna element adjacent to a leading end of the convex portion of the joint comprises a lower density than winding densities at other segments of the helical antenna element, the lower winding density is configured to provide a space into which the helical antenna element can escape when the rod bends; and wherein the joint comprises a breaking portion configured to penetrate the coating of the coating wire, the breaking portion comprising a helical structure.

16. The vehicle pole antenna according to claim 15, wherein the joint comprises an annular section surrounding a central section, the annular section is spaced from the central section and configured to secure a segment of the helical antenna element in the space.

17. The vehicle pole antenna according to claim 15, wherein the joint has a fastened portion and an annular fastening portion between which the helical antenna element is held and fastened.

* * * * *

UNITED STATES PATENT AND TRADEMARK OFFICE

CERTIFICATE OF CORRECTION

PATENT NO. : 9,153,864 B2
APPLICATION NO. : 13/397521
DATED : October 6, 2015
INVENTOR(S) : Toshihiro Iwata et al.

It is certified that error appears in the above-identified patent and that said Letters Patent is hereby corrected as shown below:

On the title page, item 56

Page 2, under References Cited, U.S. Patent Documents:

Replace "1,274,615 A1 11/2008 Wang" with

--12/746,159 A1 11/2008 Wang--

Replace "1,280,946 A1 12/2008 Lino" with --12/809,466 A1 12/2008 Lino--

Replace "1,249,511 A1 6/2009 Kobayashi" with

--12/495,112 A1 6/2009 Kobayashi--

Replace "1,289,802 A1 10/2010 Sato" with --12/898,022 A1 10/2010 Sato--

Replace "1,252,484 A1 1/2011 Wang" with --12/524,842 A1 1/2011 Wang--

Add "12/769,488 A1 4/2010 Breden"

Page 2, under Foreign Patent Documents:

Replace "JO 11-040920 2/1999" with --JP 11-040920 2/1999--

Replace "JP 60-128963 6/1985" with --JP 60-126963 7/1985--

Replace "JP U1993 039009 5/1993" with --JP 5-039009 2/1993--

Replace "JP 2008/035479 2/2006" with --JP 2008-035479 2/2008--

Replace "JP 2006-059646 3/2008" with --JP 2006-059646 3/2006--

Signed and Sealed this
Ninth Day of August, 2016

Michelle K. Lee

Michelle K. Lee
*Director of the United States Patent and Trademark Office*

Replace “WO 2008/062746 5/2006” with --WO 2008/062746 5/2008--

Replace “PCT/JP2012/050527 9/2012” with --PCT/JP2012/050527 3/2012--